United States Patent [19]

Watkins

[11] 4,099,277

[45] Jul. 11, 1978

[54] STANDER APPARATUS PROVIDING VARYING DEGREES OF WEIGHT BEARING FOR PATIENT THERAPY

[76] Inventor: Mervyn M. Watkins, 30241 Via Borica, Rancho Palos Verdes, Calif. 19154

[21] Appl. No.: 618,076

[22] Filed: Sep. 30, 1975

[51] Int. Cl.[2] ..... A61G 13/00

[52] U.S. Cl. ..... 5/81 R; 5/62; 297/DIG. 4

[58] Field of Search ..... 280/211, 242 WC, 250; 297/DIG. 4, 62, 66, 68, DIG. 10; 5/81, 86; 180/8 A

[56] References Cited

U.S. PATENT DOCUMENTS

| | | | |
|---|---|---|---|
| 2,635,899 | 4/1953 | Osbon, Jr. | 280/211 |
| 2,946,602 | 7/1960 | Lee | 280/250 |
| 3,191,990 | 6/1965 | Rugg et al. | 5/66 |
| 3,220,021 | 11/1965 | Nelson | 5/66 |
| 3,495,869 | 2/1970 | Ingemansson | 5/81 R |
| 3,593,351 | 7/1971 | Dove | 5/86 |
| 3,640,520 | 2/1972 | Wieland et al. | 5/62 |
| 3,640,566 | 2/1972 | Hodge | 297/DIG. 10 |
| 3,882,949 | 5/1975 | Anderson | 297/DIG. 4 |
| 3,997,926 | 12/1976 | England | 5/62 |

*Primary Examiner*—Casmir A. Nunberg
*Attorney, Agent, or Firm*—John Holtrichter, Jr.

[57] ABSTRACT

Hammock portion of a tiltable stretcher supports the lower half of patient at a first elevation in prone position while a tray portion of the stretcher supports head, arms and shoulders at lower elevation until stretcher is swung to a near-vertical position where tray may be adjusted to a suitable angle facilitating reading, eating, playing games and the like. The device may be provided with handrims which drop below level of stretcher in horizontal position to eliminate obstacles during patient transfer.

12 Claims, 9 Drawing Figures

STANDER APPARATUS PROVIDING VARYING DEGREES OF WEIGHT BEARING FOR PATIENT THERAPY

BACKGROUND OF THE INVENTION

The background of the invention will be set forth in two parts.

Field of the Invention

The present invention pertains generally to the field of convalescent apparatus and more particularly to a new and useful stander providing varying degrees of weight bearing for patient therapy.

Description of the Prior Art

It is essential for paraplegics or quadraplegics to undergo regular weight bearing therapy, preferably in the prone position, to minimize decubitus ulcers, bone decalcification, tightening of joints and poor circulation.

Prior art equipment includes self-propelled stretchers, tilt tables, stand-alone units and prone boards.

Self-propelled stretchers have large front wheels; the patient lays face down (prone) and may propell the front wheels in wheelchair fashion. This equipment has the disadvantages that the stretcher may not be angularly adjusted, does not offer weightbearing therapy and does not provide a work surface for the patient.

The tilt table may be angularly adjusted and some models are available with large front wheels so that, in the horizontal position only, the patient may operate the equipment as a self-propelled stretcher. In use, however, the patient typically lays on his back. This equipment suffers the disadvantages that it may be self-propelled in the horizontal position only and it only relieves pressure on decubitii in the horizontal position.

The stand-alone unit holds the patient in a vertical position by bracing his seat and legs. This unit comes with hand rims for selfpropulsion. This unit suffers the disadvantages that it may not be angularly adjusted, it does not relieve pressure on decubitii, it does not provide a work surface and it requires total upper body control.

The prone board is a simple wooden board tilted against the edge of a table and secured by C-clamps. It has a foot rest which may be adjusted for patient height and usually is used for children in a prone position. It suffers the disadvantages that it has a limited angular adjustment, is unstable and does not have mobility.

Other prior art equipment is disclosed in the following U.S. Pat. Nos.: 2,427,782; 3,042,131 2,621,707 3,107,105 2,635,899; 3,442,532.

U.S. Pat. No. 2,427,782 discloses invalid equipment having handrims for use in wheelchair fashion by a patient having the use of his hands and arms for propelling the equipment. Alternatively, the patient can use his feet and legs to propel the equipment through a pair of drums keyed to the drive wheels. The equipment may also be folded to a horizontal position.

U.S. Pat. No. 2,621,707 discloses a walkabout which may be used in wheelchair fashion when a hammock-type seat is in position. The seat may be unhooked and crutches may be connected to the walkabout so that the user may rest his weight upon the crutches and propel the walkabout by contact of one foot with the ground.

U.S. Pat. No. 2,635,899 discloses an invalid bed having front handrims which may be manipulated by a patient in the prone position. Alternatively, the front portion of the mattress on the unit may be moved to an inclined position providing a back rest for the patient who may then propel the bed by manipulating a second pair of hand rims extending above the mid portion of the mattress. This bed has the disadvantages that it may not be tilted to a near-vertical position and that the second pair of hand rims may not be dropped below the level of the mattress in the horizontal position to eliminate obstacles during patient transfer.

U.S. Pat. No. 3,042,131 discloses an invalid cart designed for use by a patient in the prone position. The cart includes pedals which may be manipulated by the patient's hands to propel the cart. The relative angularity of the supporting surface may be varied. The cart may be provided with a work tray pivotally mounted on lugs and movable from a down position to a horizontal position. One disadvantage of this cart resides in the fact that the tray may not be adjusted to different angles and may not be used to support the arms, head and shoulders of the patient. Another disadvantage resides in the fact that the supporting surface of the cart may not be adjusted to accommodate patients of different heights.

U.S. Pat. No. 3,107,105 discloses a standing support for paraplegics. This unit provides a support enabling a paraplegic to maintain an upright standing position and to propel himself under his own power from one place to another.

U.S. Pat. No. 3,442,532 discloses a portable invalid wheelchair which is collapsible and which includes small ground wheels connected by chains to hand wheels. The wheelchair is formed by upper and lower mutually pivoted frames that are each unitary and permit vertical collapsing of the unit.

SUMMARY OF THE INVENTION

In view of the foregoing factors and conditions characteristic of prior art equipment of the type described, it is a primary object of the present invention to provide a new and useful stander apparatus providing a varying degree of weight bearing for patient therapy efficiently and expeditiously.

It is another object of the present invention to provide a device of the type described including an adjustable support for supporting the head, arms and shoulders of a patient at a lower elevation than the lower portion of the patient when the patient is in a prone position.

According to the present invention, a new and useful stander apparatus is provided. It may be provided with drive wheels and handrims conveniently located for manipulation by the patient regardless of the position of the patient-supporting surface. The apparatus may also be provided with a tray especially designed for both supporting the head, arms and shoulders of the patient in a prone position at an elevation below the elevation of the main body-supporting portion of the apparatus and tilted to various angles for use as a tray when the body-supporting surface is in a near-vertical position.

The apparatus includes a frame assembly having a pair of spaced, substantially parallel side frames in each of which a roller is trapped for rolling movement. The rollers are connected together by an axle to which the rear portion of the stretcher assembly is pivotally connected. A drive wheel is rotatably mounted on an axle at the front of each side frame. A main stretcher-supporting strut has one end pivotally connected to each drive wheel axle and its other end pivotally connected to an intermediate portion of the stretcher assembly. This end of each strut also carries the axle for a handrim in a position which is offset from the major axis of the strut so that the handrim falls below the upper surface of the stretcher assembly when it is in a horizontal position to eliminate obstacles during patient transfer. The handrims are accessible to the patient regardless of the position of the stretcher assembly.

A lifting device may be connected to the stretcher assembly adjacent its front end for exerting an upward force on the front end of the stretcher assembly to move it from a horizontal position to a near-vertical position or any intermediate position. The stretcher assembly may be adjusted to accommodate patients of different height and includes a stretcher frame having a front portion and a rear portion. A first body-supporting hammock is affixed to the rear portion of the stretcher frame and a second body-supporting hammock is adjustably connected to the front portion of the stretcher frame. The stretcher assembly also includes a foot rest which may be adjustably connected to the rear portion of the stretcher frame adjacent the first body-supporting hammock.

The features of the present invention which are believed to be novel are set forth with particularity in the appended claims. The present invention, both as to its organization and manner of operation, together with further objects and advantages thereof, may best be understood by making reference to the following description, taken in connection with the accompanying drawings in which like reference characters refer to like elements in the several views.

Figures 1, 1A:
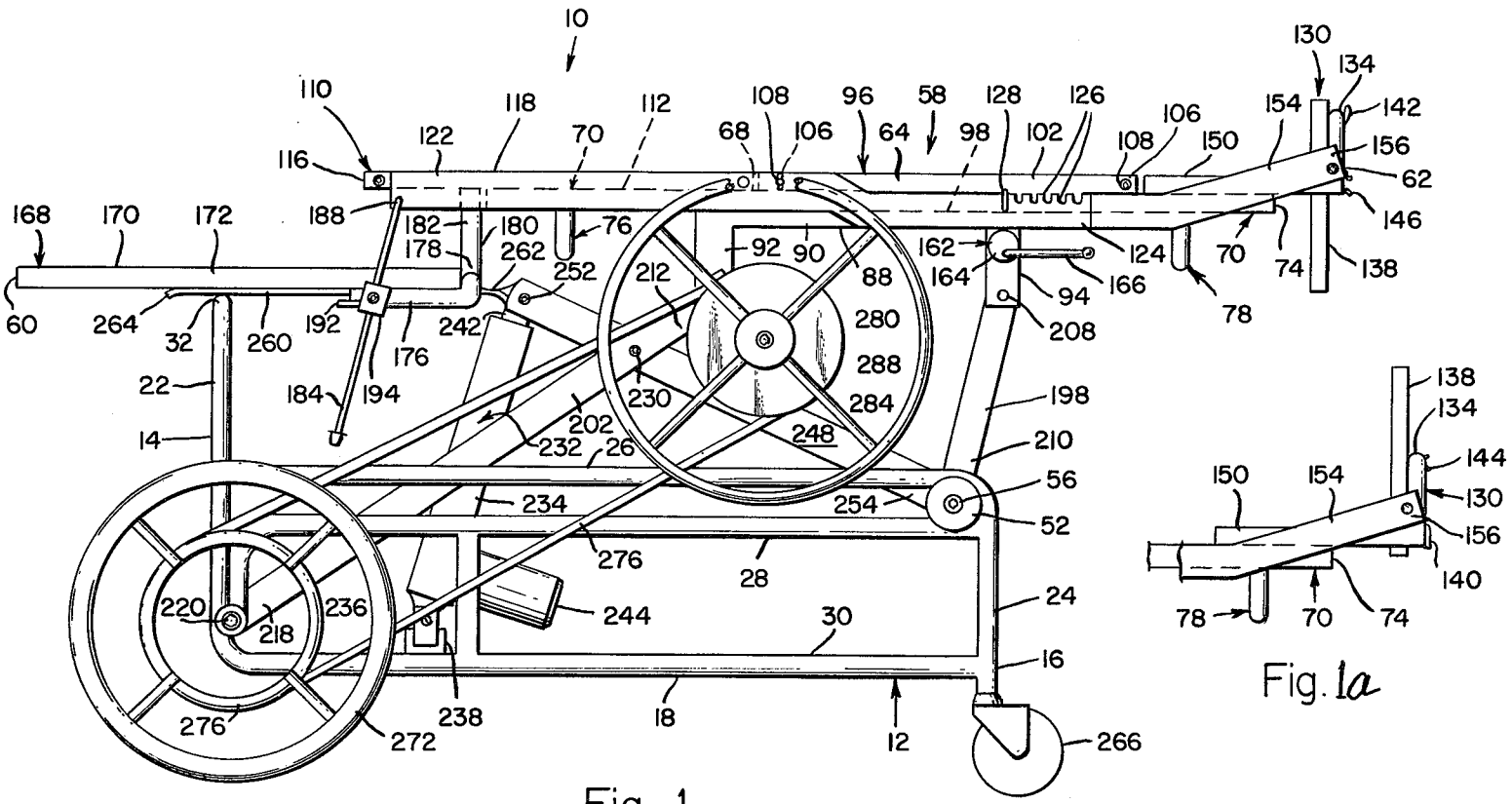
FIG. 1 is a side elevational view of a stander apparatus constituting a presently-preferred embodiment of the invention.
FIG. 1A illustrates an alternate position of the footrest plate from that shown in FIG. 1.
Figure 6:
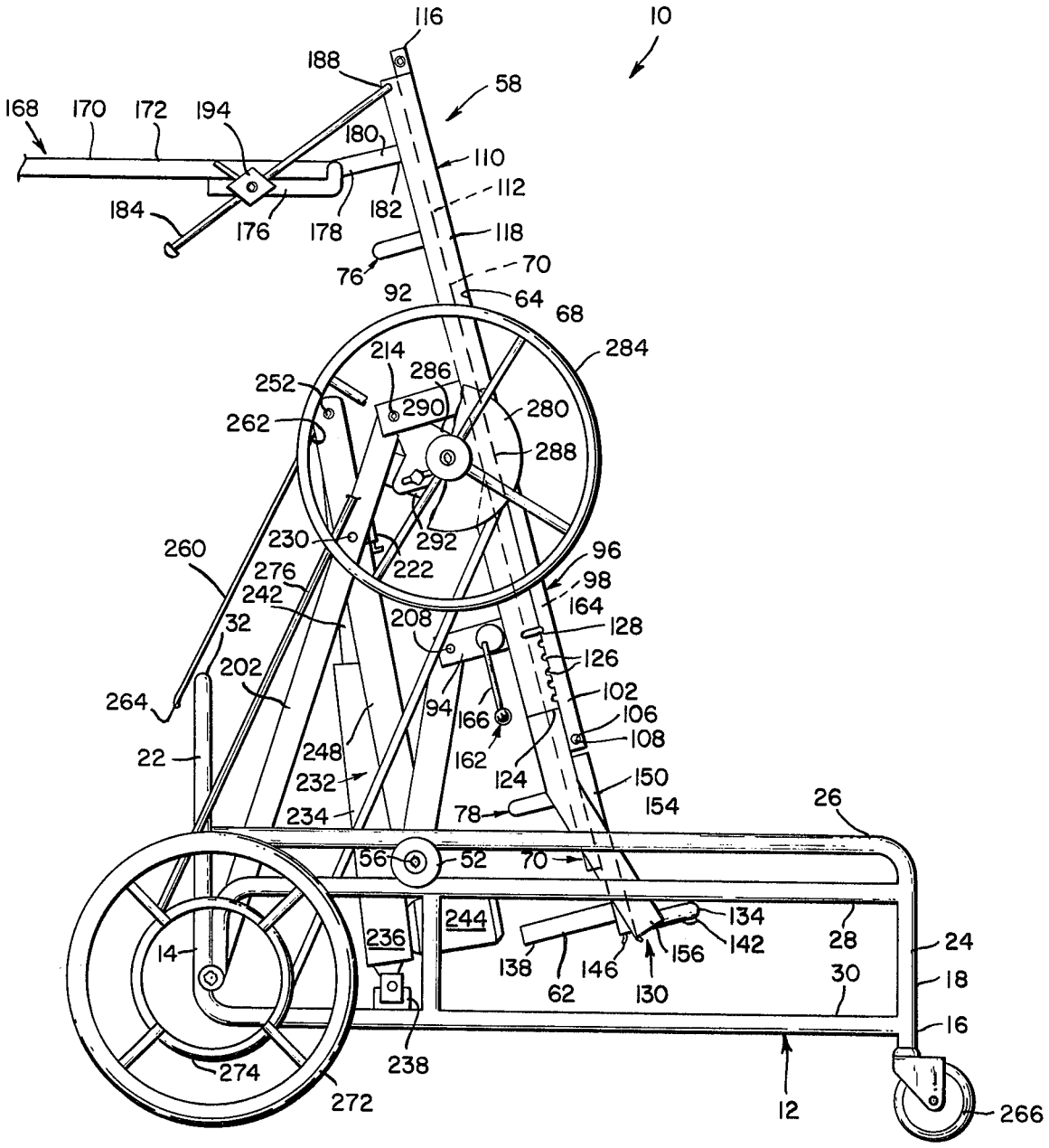
FIG. 6 is an elevational view of the device of FIG. 1 in its near-vertical position.

DESCRIPTION OF THE PREFERRED EMBODIMENT:

Referring again to the drawings, and more particularly to FIGS. 1–5, a stander apparatus constituting a presently-preferred embodiment of the invention, generally designated 10, includes a frame assembly 12 having a front end 14 and a rear end 16. Frame assembly 12 includes a pair of spaced, substantially parallel side frames 18, 20 each having an upstanding front frame member 22 and an upstanding rear frame member 24 to which upper, intermediate and lower rails 26, 28 and 30, respectively, are affixed, as shown in FIG. 1 and 6 for the side rail 18. Frame assembly 12 also includes an upper transverse rail 32 having a first end 34 affixed to the upper end 36 of the upstanding frame member 14 on side frame 20 and a second end 38 affixed to the upper end 40 of the upstanding front frame member 14 on side frame 18 and a lower transverse rail 42 having a first end 44 affixed to the lower end 46 of the upstanding frame member 14 on side frame 20 and a second end 48 affixed to the lower end 50 of the upstanding member 14 on side member 18.

The stander 10 also includes a pair of rollers 52, 54 trapped between upper rail 26 and intermediate rail 28 on sides 18, 20, respectively. A roller axle 56 connects roller 52, 54 together for rolling movement between ends 14, 16 of frame assembly 12.

Stander apparatus 10 also includes a stretcher assembly 58 having a front end 60, a rear end 62, a first edge 64, a second edge 66 and an intermediate portion 68.

Stretcher assembly 58 includes a stretcher frame 70 having a pair of rails 72, 74 (FIGS. 3 and 4) maintained in substantially parallel, spaced relationship by a front U-shaped bracket 76 and a rear U-shaped bracket 78 each having a bight portion 80 and upstanding legs 82, 84 connected to rails 72, 74, respectively. The pair of brackets 86, 88 (FIGS. 3 and 4) may be affixed to rails 72, 74, respectively. As best shown in FIG. 1 for bracket 88, each bracket has a bight portion 90 and depending legs 92, 94.

Stretcher assembly 58 also includes a first body-supporting hammock 96 supported by a rear portion 98 of stretcher frame 70 and including a pair of rails 100, 102, which may be suitably affixed to rails 72, 74, respectively, and a double layer hammock 104 of breathable, frame and moisture resistant vinyl coated nylon fabric which may be affixed to rails 100, 102 by suitable bolts 106 having nuts 108 for adjusting the tautness of hammock 104.

Stretcher assembly 58 also includes a second body-supporting hammock 110 which may be adjustably supported by a front portion 112 of stretcher frame 70. The second body-supporting hammock 110 includes a pair of rails 114, 116 adjustably mounted on rails 100, 102 of stretcher frame 70 by mounting bars 118, 120, respectively. The mounting bars 118, 120 have ends 122 affixed to rails 114, 116, respectively, and second, free ends 124 provided with a plurality of notches 126 selectively engageable under hooks 128 for adjusting the length of stretcher assembly 58 to accommodate patients of varying height.

Stretcher assembly 58 also includes a foot rest assembly 130 including a D-shaped frame 132 having an upper rail 134 and a lower rail 136 to which a foot plate 138 may be removably affixed by clips 140, 142 and clamps 144, 146, respectively, for mounting plate 138 in the position shown in FIG. 1, 4, 5 and 6 for supporting a patient in a prone position. Alternatively, plate 138 may be reversed to the position shown in FIG. 1A for supporting a patient in a supine position. Foot rest 130 may be adjustably mounted on the rear portion 98 of stretcher frame 70 by a pair of rails 148, 150, engageable upon rails 72, 74, respectively, and a pair of mounting brackets 152, 154 each having a first end 156 affixed to an associated one of the rails 148, 150 and a second free end 158 having a plurality of notches 160 selectively engageable under hooks 128 for adjusting footrest 130 to accommodate patients of varying height. The free ends 124 of mounting bars 118, 120 and the free ends 158 of mounting bars 152, 154 may be maintained in engagement with their hooks 128 by suitable overthrow mechanisms, like the one shown at 162 in FIGS. 1 and 6 for mounting bars 118 and 154. Overthrow mechanism 162 includes an eccentric 164, which is rotatably mounted in depending leg 94 on bracket 90, and a lever 166, which is affixed to eccentric 164 for moving it into binding engagement with its associated mounting bars.

Stretcher assembly 58 also includes a tray assembly 168 consisting of a board 170 having its edges 172, 174 each affixed to an arm, like the L-shaped arm 176 shown in FIG. 1 and 6 for edge 172. Each arm 176 is rotatably connected to the lower end 178 of a post 180 having its upper end 182 affixed to one of the associated rails 114, 116 (FIG. 3) for swingably connecting board 170 to the second body-supporting hammock 110. Board 170 may be maintained in the horizontal position shown in FIG. 1 or in different angular positions with respect to stretcher frame 70 by a pair of rods 184, 186 (FIG. 3) each having an upper end 188 pivotally connected to an associated one of the mounting brackets 118, 120 and an intermediate portion 190 releasably secured to a bracket 192 by a coupling 194. Bracket 192 may be engaged either with board 170 or arms 176, depending upon the angle between board 170 and stretcher frame 70. When tray assembly 168 is in the horizontal position shown in FIG. 1, a patient may lie on stretcher assembly 58 in a prone position with his feet against footrest 130 and his arms and shoulders upon board 170 in such a position that the patient may rest his head upon his hands. Alternatively, the second body-supporting hammock 110 may be moved toward front end 14 of frame 12 to elongate stretcher assembly 58 sufficiently that tray assembly 168 need not be used for supporting the shoulders, arms and head of the patient. This, of course, is a less comfortable arrangement for the prone position. However, it permits more versatility in changing weight bearing on the patient in both the prone and supine positions.

Figure 3:
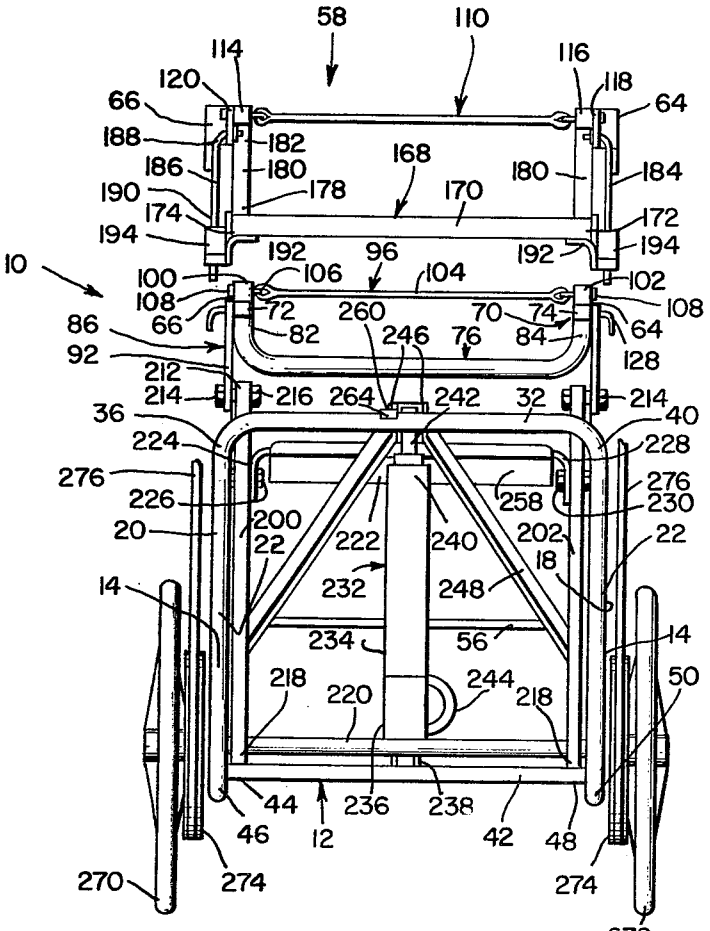
FIG. 3 is an exploded, front view of the device of FIG. 1 with parts omitted for clarity.
Figure 5:
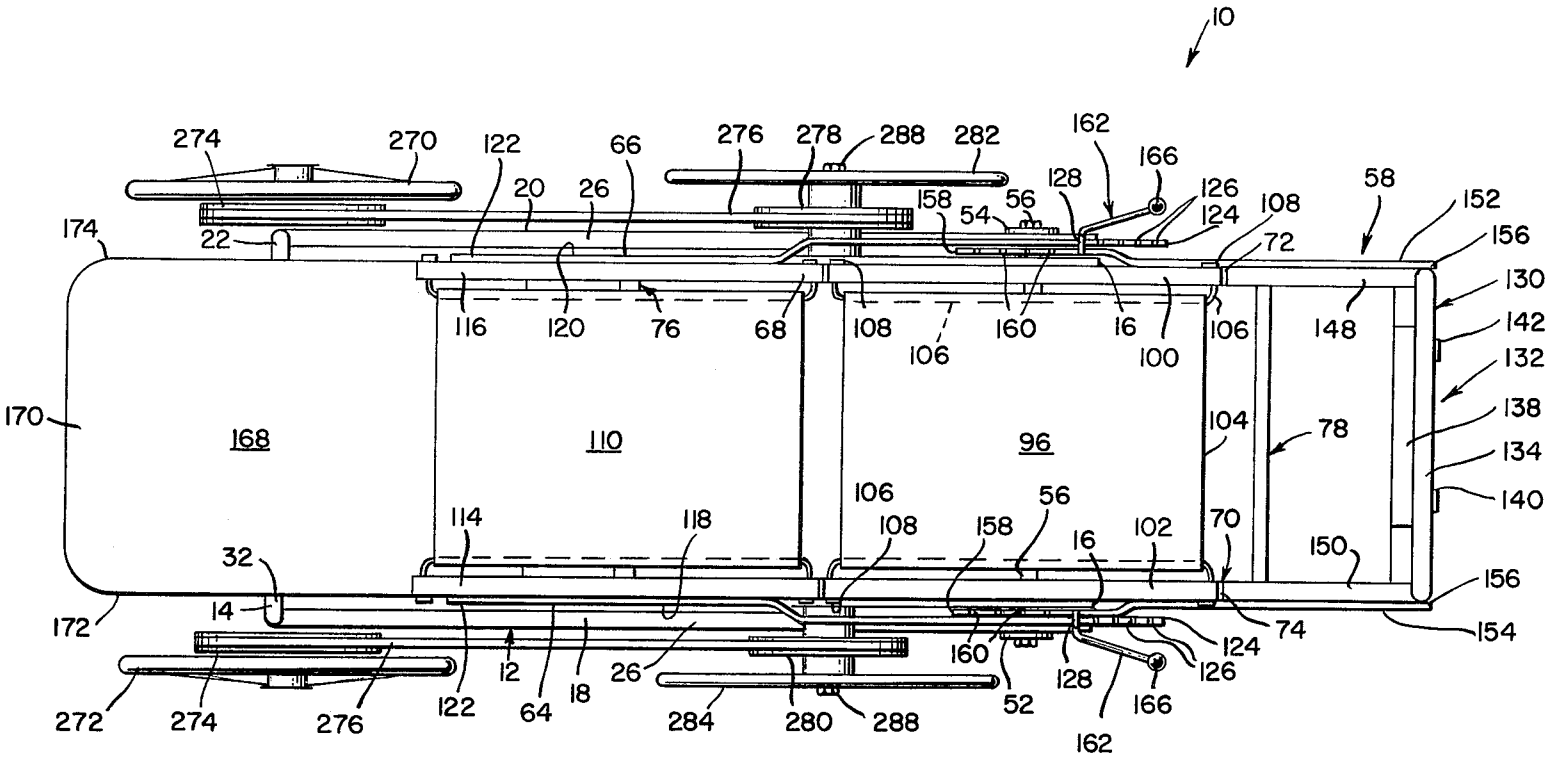
FIG. 5 is a top plan view of the device of FIG. 1.

Stretcher assembly 58 may be connected to frame assembly 12 by a pair of rear struts 196, 198 (FIG. 4) and a pair of front struts 200, 202 (FIG. 3). Struts 196, 198 each have an upper end 204 connected to an associated one of the depending legs 94 on bracket 88 by a bolt 206 and a nut 208 and a lower end 210 pivotally connected to roller axle 56. Each struct 200, 202 has an upper end 212 pivotally connected to the depending legs 92 on an associated one of the brackets 86, 88 by a bolt 214 and a nut 216 and a lower end 218 pivotally connected to a drive axle 220 to be further described hereinafter. Struts 200, 202 are connected together intermediate their ends by a transverse bar 222 (FIGS. 3 and 4) having a first end 224 connected to strut 200 by a bolt and nut assembly 226 and a second end 228 connected to strut 202 by a bolt and nut assembly 230.

Figure 2:
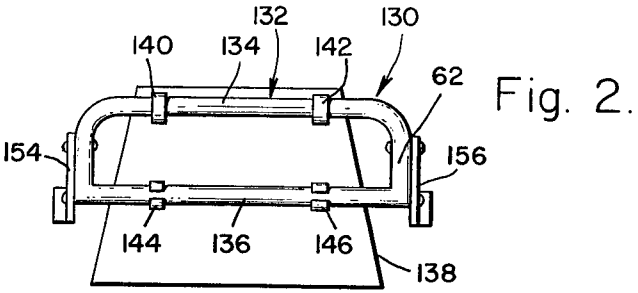
FIG. 2 is a partial elevational view of the device of FIG. 1 showing an alternate arrangement for the footrest portion of the device.
Figure 4:
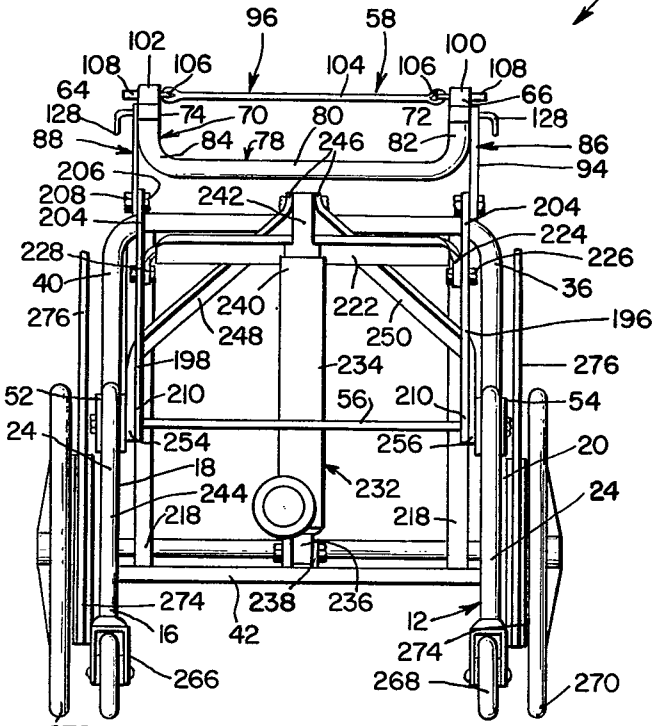
FIG. 4 is an exploded, rear view of the device of FIG. 1 with parts omitted for clarity.

Stander apparatus 10 also includes a lifting device 232 which is connected to the stretcher assembly 58 adjacent its front end for exerting an upward force to move the stretcher assembly to any desired angular position between the horizontal position shown in FIG. 1 and the near-vertical position shown in FIG. 2 where stretcher assembly 58 is approximately 70° from the horizontal. Lifting device 232 may consist of an electromechanical jack including a housing 234 having a lower end 236 pivotally connected to a bracket 238 affixed to transverse rail 42 and an upper end 240 telescopically receiving a screw 242 driven by an electric motor 244 mounted on the lower end 236 of housing 234. Motor 244 may be used to extend screw 242 from the position shown in FIGS. 3 and 4 to the extended position shown in FIG. 6. Screw 242 is connected to the ends 246 of a pair of yoke arms 248, 250 (FIGS. 3 and 4) by a bolt and nut assembly 252. The lower end 254 of yoke arm 248 is pivotally connected to roller axle 56 between strut 198 and roller 52 and the lower end 256 of yoke arm 250 is pivotally connected to roller axle 56 between strut 196 and roller 54. Each yoke arm 248, 250 is affixed to the underside 258 of transverse bar 222 adjacent ends 246 of arms 248, 250 for transmitting the lifting force exerted by screw 242 to struts 200, 202 while ends 254, 256 of yoke arms 248, 250 pull roller axle 56 and rollers 52, 54 away from rear end 16 of frame assembly 12. As best seen in FIGS. 1, 3 and 6, a guide bar 260 has a first end 262 pivotally connected to bolt and nut assembly 252 between ends 246 of yoke arms 248, 250 and a second end 264 engageable with transverse rail 32 on top of upright rails 20, 22 on frame 12 for guiding tray 168 into a horizontal position when it is released from its FIG. 6 position so that it will not become trapped between upright rails 20, 22 and struts 200, 202.

Stander apparatus 10 may be given wheelchair-type mobility by providing it with a pair of castors 266, 268 at its rear end and a pair of drive wheels 270, 272 at its front end. Each drive wheel 270, 272 carries a pulley 274 about which a belt 276 may be trained. Each belt 276 is also trained about an associated one of the pulleys 278, 280 carried by handrims 282, 284, respectively (FIG. 5), each rotatably mounted on a suitable bracket, like the one shown at 286 in FIG. 6, by a bolt 288. Each bracket 286 is pivotally mounted on a bolt 214 at the upper end of an associated one of the struts 200, 202 and is fixed in position by a bolt 288 engaged in a slot 290 on bracket 286 and a fixed bracket 292 carried by an associated one of the struts 200, 202. Bolt 228 may be loosened so that bracket 286 may be swung to a suitable position to tighten belt 276. It should be noted that bolt 288 places the center of rotation of its associated handrim 282, 284 offset from the major axis of the associated strut 200, 202 so that handrims 282, 284 will drop below the upper surface of stretcher assembly 58 when it is moved from the position shown in FIG. 6 to the horizontal position shown in FIG. 1. Although the drive system for drive wheels 270, 272 has been shown and described for purposes of illustration, but not of limitation, as comprising a two-arm drive system, it will be understood that the drive system may be a universal manual drive system of the type disclosed and claimed in applicant's U.S. Pat. No. 3,899,189.

Operation of the device will be readily understood. Stretcher assembly 58 may be adjusted to fit a particular patient by releasing levers 166, (FIG. 5) so that the second body-supporting hammock and the footrest 130 may be moved to a suitable position. If it is desired to place a patient on stretcher assembly 58 in a supine position, then footplate 138 may be moved from its FIG. 1 position to its FIG. 2 position. Assuming, however, that stretcher assembly 58 is in its FIG. 1 position, a patient may be placed on stretcher assembly 58 in a prone position with his head, arms and shoulders supported by tray 168. Tray 168 may be elevated slightly, if this will make it more comfortable for the patient. Motor 244 may then be energized to position stretcher assembly 58 at varying angles in order to achieve weight bearing on the legs of the patient. Additionally, the patient may be put in a standing position by elevating stretcher assembly 58 to the position shown in 56 where it is in a near-vertical position of approximately 70°. Tray 168 may be then adjusted to the position shown in FIG. 6 to provide a working surface for the patient. Handrims 282, 284 are accessible to the patient in all positions of stretcher assembly 58 to provide a measure of independence during therapy by being self-propelled.

It is apparent that stretcher assembly 58 may be adjusted from a horizontal position to a near-vertical position with the patient on stretcher assembly 58. As previously noted, handrims 282, 284 drop below the upper surface of stretcher assembly 58 when it is moved to the horizontal position. This eliminates obstacles during patient transfer from a bed to stretcher assembly 58.

The frame, struts, rails, brackets and the like may comprise a welded structure of cold rolled steel tubing and bar stock. The lifting device 232 may be a 500 pound capacity electromechanical screw jack, with a five second thermal overload switch and an automatic ten second reset.

The rear castors 266, 268 may be 5 inch diameter with solid rubber tires and may be provided with a foot lock (not shown). The drive wheels 270, 272 may be twenty inch diameter laced wheels with solid rubber tires and a ⅝ inch diameter axle.

Tray 168 may measure 20 inches × 20 inches × 162 inch with a formica finish and is fully adjustable to any position.

Figure 7:
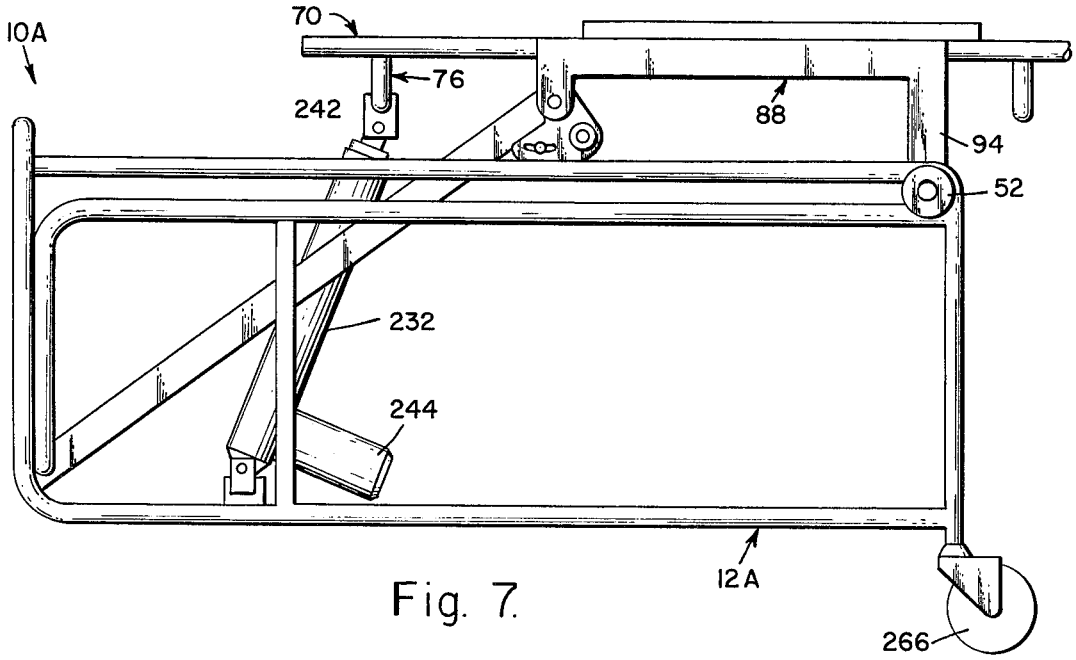
FIG. 7 is a side elevational view showing a modification of a portion of the device of FIG. 1.
Figure 8:
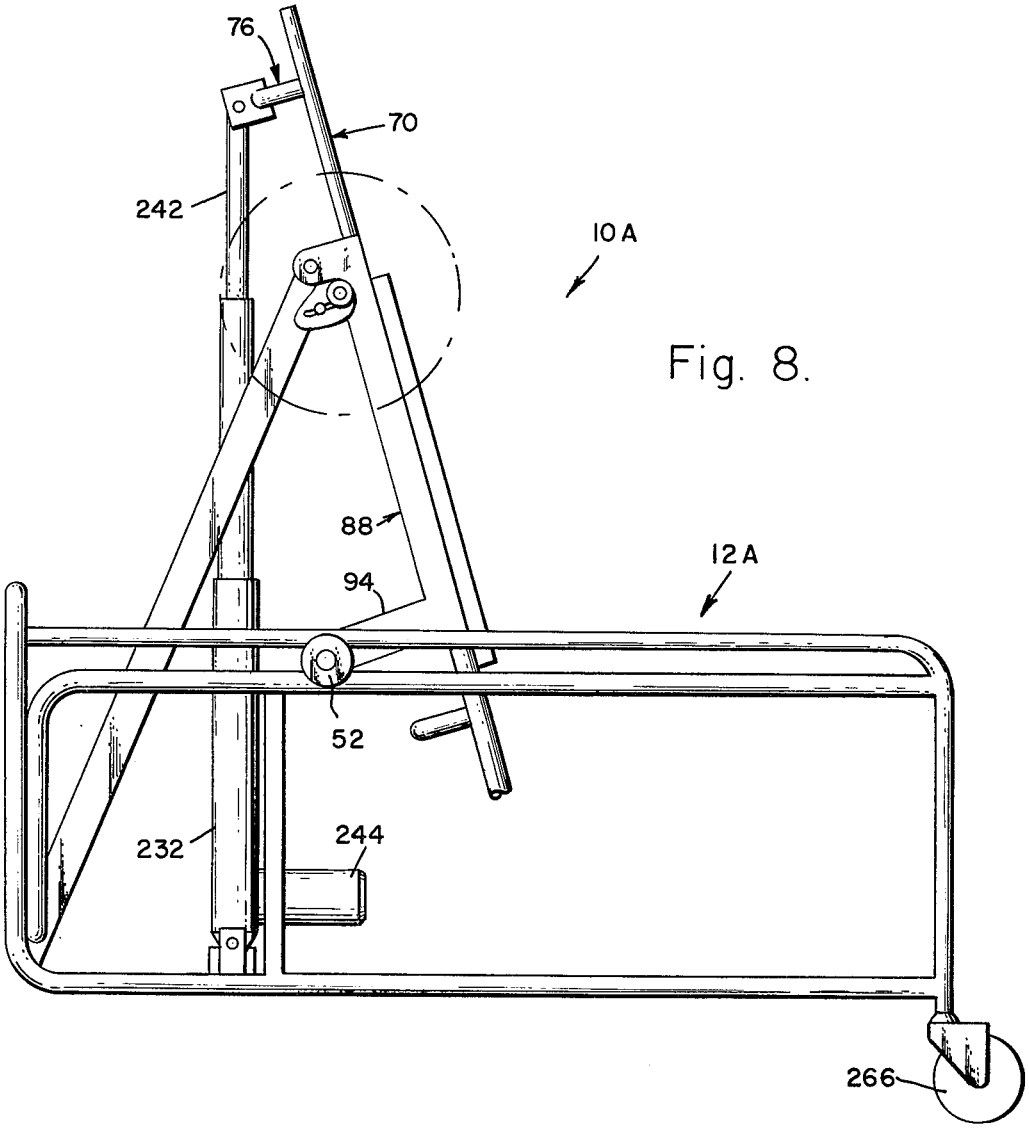
FIG. 8 is a side elevational view of the device of FIG. 7 in a near-vertical position.

Referring now to FIGS. 7 and 8, a modified stander apparatus 10A may be identical to the apparatus 10 except that the front struts and the yoke may be eliminated. The stretcher assembly 58 shown in FIGS. 1 - 6 has been eliminated for clarity. The lower end of depending leg 94 of the brackets, like the one shown at 88, may be pivotally connected directly to the rollers, like the one shown at 52.

The screw 242 on lifting device 232 is then connected to the transverse U-shaped bracket 76 for lifting frame assembly 70 from the horizontal position shown in FIG. 7 to the near-vertical position shown in FIG. 8.

Frame assembly 12A may then have its geometry changed, as shown, to accommodate the different positions frame 70 will assume by eliminating rear struts 196, 198 and yoke arms 248, 250.

From the foregoing, it should be evident that there has herein been described a stander apparatus for providing varying degrees of weight bearing therapy to a patient having an adjustable stretcher assembly and a lifting device which efficiently and reliably positions the stretcher assembly in any position from a horizontal position to a near-vertical position of approximately 70°.

Although exemplary embodiments of the invention have been shown and described, changes and modifications and other embodiments of the invention may be made by one having ordinary skills in the art without necessarily departing from the spirit and scope of the invention.

What is claimed is:

1. Apparatus for providing varying degrees of weight bearing therapy to a patient having a body including an upper body portion and a lower body portion, said upper body portion including a head, a pair of arms and shoulders, said apparatus comprising:

a frame assembly having a front end and a rear end, said frame assembly including a pair of spaced, substantially parallel side frames each having upstanding front and rear frame members and upper, intermediate and lower rails each having an end affixed to an associated one of said front and rear frame members, said frame assembly also including upper and lower transverse rails each having an end affixed to an associated one of the upper and lower ends of said upstanding front frame member;

a roller trapped between an upper rail and an intermediate rail on each of said side frames;

a roller axle connecting said rollers together for rolling movement from said rear end of said frame assembly to a position near said front end of said frame assembly;

a stretcher assembly having a front end, a rear end, a first edge, a second edge and an intermediate portion;

a first strut pivotally connecting said rear end of said stretcher assembly to said roller axle adjacent one of said side frames;

a second strut pivotally connecting said rear end of said stretcher assembly to said roller axle adjacent the other of said side frames;

a third strut pivotally connecting said intermediate portion of said stretcher assembly to one of said side frames adjacent the juncture of one of said lower rails and said front frame member;

a fourth strut pivotally connecting said intermediate portion of said stretcher assembly to the other of said side frames adjacent the juncture of the other of said lower rails and said front frame member; and a lifting device connected to said stretcher assembly adjacent its front end for exerting an upward force on the front end of said stretcher assembly to move it from a horizontal position to a near-vertical position.

2. An apparatus as stated in claim 1 wherein said stretcher assembly comprises:

a stretcher frame having a front portion and a rear portion;

a first body-supporting hammock supported by the rear portion of said stretcher frame; and a second body-supporting hammock supported by the front portion of said stretcher frame.

3. An apparatus as stated in claim 2 including a foot rest and means for adjustably connecting said foot rest to said rear portion of said stretcher frame adjacent said first body-supporting hammock.

4. An apparatus as stated in claim 2 including means for adjustably connecting one of said body-supporting hammocks to said stretcher frame, whereby said stretcher assembly may be adjusted to fit patients of different height.

5. An apparatus as stated in claim 1 including:

a pair of drive wheels mounted on said front end of said frame assembly, each of said drive wheels being rotatably mounted on an axle affixed to said frame assembly, said third and fourth struts each having a first end pivotally connected to an associated one of said drive-wheel axles and a second end pivotally connected to said intermediate portion of said stretcher assembly;

a handrim for driving each of said drive wheels;

a handrim bracket adjustably mounted on the second end of each of said third and fourth struts;

a handrim axle mounting said handrims on an associated one of said handrim brackets in positions which are offset from the major axes of said third and fourth struts, whereby said handrims will fall below the upper surface of said stretcher assembly when it is moved to a horizontal position to eliminate obstacles during patient transfer; and an endless driver connecting each handrim to an associated one of said drive wheels.

6. An apparatus as stated in claim 1 including:

a tray assembly for supporting said upper body portion of said patient in a prone position; and means for supporting said tray assembly in a fixed position substantially parallel to, and at a lower elevation than, said stretcher assembly when it is in a horizontal position.

7. An apparatus as stated in claim 1 including:

a bracket connecting said third and fourth struts together;

a first yoke arm having a lower end connected to said roller axle adjacent one of said rollers;

a second yoke arm having a lower end connected to said roller axle adjacent the other of said rollers, each of said yoke arms having an intermediate portion affixed to said bracket connecting said third and fourth struts together, each of said yoke arms also having an upper end; and means for connecting said upper ends of said yoke arms to said lifting device.

8. Apparatus for tiltably supporting a patient lying full-length in a procumbent position, comprising:

an elongated frame assembly having upper, middle and lower portions;

body support means mounted on said frame assembly for supporting a patient in a fully-extended procumbent position relative to said frame assembly;

tilt means attached to said frame assembly for adjusting the tilt of the entire length of said longitudinal frame assembly relative to the horizontal;

weight bearing support means mounted on said lower portion of said frame assembly for accepting patient weight-bearing pressure thereon when said frame assembly is tilted above the horizontal by said tilt means; and an upper support platform positionable in a plane substantially parallel to said middle portion of said frame assembly.

9. The apparatus according to claim 8 wherein said upper support platform is tiltable with respect to the remainder of said frame assembly.

10. Apparatus for tiltably supporting a patient lying full-length in a procumbent position, comprising:

an elongated frame assembly having upper and lower portions;

body support means mounted on said frame assembly for supporting a patient in a fully-extended procumbent position relative to said frame assembly;

tilt means attached to said frame assembly for adjusting the tilt of the entire length of said longitudinal frame assembly relative to the horizontal;

weight bearing support means mounted on said lower portion of said frame assembly for accepting patient weight-bearing pressure thereon when said frame assembly is tilted above the horizontal by said tilt means; and propulsion means attached to said frame assembly and including frame assembly-mounted hand rim and ground wheels, said propulsion means also including means for movably mounting said hand rim in a position extending above the upper portion of said frame assembly when it is in a near-vertical position and to a position below said upper portion of said frame assembly when said frame is in said horizontal position.

11. The apparatus according to claim 10, wherein said rim and ground wheels are axle-mounted, and wherein said propulsion means further includes means for fixedly maintaining the distance between the hand rim supporting axle and the axle supporting the powered ones of said ground wheels throughout said movement of said frame assembly between said near-vertical and said horizontal position.

12. The apparatus according to claim 11, wherein said propulsion means further includes respective drive and driven pulleys fixedly coupled to said hand rim and to said powered ones of said ground wheels, and a flexible endless belt operatively coupling together said pulleys.

* * * * *